US011788526B2

(12) United States Patent
Nishido et al.

(10) Patent No.: US 11,788,526 B2
(45) Date of Patent: Oct. 17, 2023

(54) AIR COMPRESSOR

(71) Applicant: MAKITA CORPORATION, Anjo (JP)

(72) Inventors: Noriyuki Nishido, Anjo (JP); Tomohiro Hachisuka, Anjo (JP); Makito Teramoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/836,604

(22) Filed: Jun. 9, 2022

(65) Prior Publication Data

US 2023/0038911 A1 Feb. 9, 2023

(30) Foreign Application Priority Data

Aug. 5, 2021 (JP) ..... 2021-128856

(51) Int. Cl.
*F04B 41/02* (2006.01)
*F04B 39/00* (2006.01)

(52) U.S. Cl.
CPC ..... *F04B 41/02* (2013.01); *F04B 39/005* (2013.01); *F04B 39/0033* (2013.01); *F04B 39/0061* (2013.01); *F04B 39/0083* (2013.01); *Y10S 55/17* (2013.01)

(58) Field of Classification Search
CPC ..... F04B 39/0033; F04B 39/005; F04B 39/0083; F04B 41/02; F04B 39/0061; Y10S 55/17
See application file for complete search history.

(56) References Cited

U.S. PATENT DOCUMENTS 1,326,647 A * 12/1919 Cotton et al. ..... F24D 19/087 181/258
1,917,542 A * 7/1933 Ploen ..... E04B 9/06 181/233
1,993,895 A * 3/1935 Ploen ..... F01N 1/083 181/264
2,698,061 A * 12/1954 Jaubert ..... B01D 46/30 96/136
2,825,425 A * 3/1958 Jacovelli ..... F16T 1/14 137/107
3,672,465 A * 6/1972 Blatt ..... F01N 13/16 181/258
3,675,733 A * 7/1972 Blatt ..... F01N 13/00 181/237

(Continued)

FOREIGN PATENT DOCUMENTS

JP 2019-157791 A 9/2019

*Primary Examiner* — Christopher S Bobish
(74) *Attorney, Agent, or Firm* — Oliff PLC

(57) ABSTRACT

An air compressor comprises a compressor that compresses introduced air and a tank that stores the compressed air generated by the compressor. The air compressor also comprises a discharge pipe from which the compressed air and a condensate in the tank are discharged to an outside of the tank. The air compressor also comprises a drain cock that is disposed in a passage of the discharge pipe and serves to open and close the discharge pipe. The air compressor also comprises a discharge pipe end portion that includes a discharge port facing upward at a tip end of the discharge pipe. The air compressor also comprises a tubular cover including a top portion that covers the discharge pipe end portion from above.

16 Claims, 8 Drawing Sheets

(56) References Cited

U.S. PATENT DOCUMENTS

| | | | | | |
|---|---|---|---|---|---|
| 3,675,734 | A * | 7/1972 | Blatt | F04B 39/0083 | 181/268 |
| 3,680,659 | A * | 8/1972 | Kasten | F04B 39/0083 | 55/486 |
| 3,698,510 | A * | 10/1972 | Blatt | F01N 13/20 | 181/258 |
| 3,802,795 | A * | 4/1974 | Nyeste | F04D 25/028 | 415/199.1 |
| 4,242,111 | A * | 12/1980 | Arends | B01D 53/265 | 55/323 |
| 4,655,317 | A * | 4/1987 | Kolya | B60T 17/008 | 181/258 |
| 5,144,974 | A * | 9/1992 | Gaudin | F16T 1/00 | 137/204 |
| 5,266,754 | A * | 11/1993 | Swift | G10K 11/16 | 181/275 |
| 8,123,831 | B2 * | 2/2012 | Heikamp | B01D 46/2411 | 55/501 |
| 8,191,675 | B2 * | 6/2012 | Weber | F16L 55/0336 | 181/258 |
| 9,435,329 | B2 * | 9/2016 | Kitagawa | F04B 35/06 | |
| 11,293,420 | B2 * | 4/2022 | Nielsen | A61G 3/062 | |
| 11,505,171 | B2 * | 11/2022 | Sovago | F15B 21/008 | |
| 2010/0290929 | A1 * | 11/2010 | Ohi | F04B 41/02 | 417/360 |
| 2011/0290354 | A1 * | 12/2011 | Wood | F04B 35/06 | 137/565.17 |
| 2019/0285065 | A1 * | 9/2019 | Hachisuka | F04B 39/005 | |

* cited by examiner

AIR COMPRESSOR

CROSS-REFERENCE TO RELATED APPLICATIONS

This application claims priority to Japanese patent application serial number 2021-128856, filed on Aug. 5, 2021, the contents of which are incorporated herein by reference in their entirety for all purposes.

BACKGROUND

The present disclosure generally relates to an air compressor that compresses introduced air and stores the compressed air.

An air compressor may generate compressed air by, for example, a piston mechanism. Generally, the air compressor may introduce outside air, bring it to the inside of a cylinder, and compress it using a piston to generate compressed air inside the cylinder. The compressed air thus generated may be delivered to a storage tank for storage. The compressed air stored in the tank may be supplied to an air-powered tool, for example a nail driver or an air tacker, for the operation thereof. When the compressed air is released from the tank, for instance for the operation of the air-powered tool, the remaining compressed air in the tank may expand. As a result, the compressed air may be cooled. Due to this cooling effect, water vapor primarily from the remaining compressed air within the tank may condense to produce a condensate (water or drainage), which may accumulate inside the tank. The condensate accumulated in the tank may cause rust to develop within the tank and, in some situations, may result in a decrease in the storage quantity of the compressed air. To avoid these defects, an air compressor may have a condensate discharge portion for discharging the condensate to the outside of the tank.

A condensate discharge portion may include a discharge pipe in fluid communication with the tank and a drain cock. The drain cock serves to open and close the condensate discharge pipe. When the drain cock is opened, the compressed air and the condensate in the tank may be discharged from a discharge port at a tip end of the discharge pipe. The discharge port of the discharge pipe may be introduced into a muffling chamber disposed at a lower portion of an air compressor main body. The muffling chamber may be formed in a rectangular box shape through the cooperation of a recess formed in an underguard that covers a lower portion of the air compressor main body and a lower cover that is attached to the lower portion of the underguard. The muffling chamber may have a horizontally long shape extending in a longitudinal direction of the tank. The muffling chamber may be packed with a muffling member in order to reduce a loud noise generated when the compressed air is rapidly discharged from the discharge port of the discharge pipe. The discharge port of the discharge pipe may open in approximately a horizontal direction. An upper surface of the lower cover may be tilted downward toward an opening of the muffling chamber.

The above-described configuration may reduce the possibility of a loud noise being generated when the compressed air is discharged from the discharge port of the discharge pipe. The above configuration may also restrict the condensate from being scattered to the outside of the air compressor. The condensate discharged to the inside of the muffling chamber may be guided toward the outside opening of the muffling chamber due to the tilted upper surface of the lower cover, thereby discharging the condensate to the outside of the air compressor in a single location, e.g., the outside opening of the muffling chamber.

However, since the compressed air and the condensate may be strongly and rapidly discharged from the discharge port of the discharge pipe in approximately a horizontal direction, the muffling chamber may not always be able to fully reduce the strength of the compressed air and the condensate. This may cause the condensate to leak from a connection gap formed between the underguard and the lower cover. Since the muffling chamber may be long in the longitudinal direction of the tank, the connection area between the underguard and the lower cover may be large, thereby increasing a potential discharge area of the condensate. Due to this configuration, there is an increased chance that the condensate may be scattered around the outside of the air compressor.

SUMMARY

As a result of the mentioned deficiencies, there is a need in the art to reduce a discharge area of the condensate discharged to the outside of the air compressor.

According to one aspect of the present disclosure, an air compressor comprises a compressor that compresses introduced air and a tank that stores the compressed air generated by the compressed. The air compressor also comprises a discharge pipe from which the compressed air and a condensate in the tank are discharged to an outside of the tank. The air compressor also comprises a drain cock that is disposed within a passage of the discharge pipe and serves to open and close the discharge pipe. The air compressor also comprises a discharge pipe end portion including a discharge port facing upward at a tip end of the discharge pipe. A tubular cover includes a top portion that covers the discharge pipe end portion from above.

Because of this configuration, the compressed air and the condensate are discharged toward the inside of the tubular cover from the discharge port facing upward. The top portion of the tubular cover serves to restrict the condensate from being discharged above the top portion. Since the condensate is discharged upward from the discharge port, the condensate may be restricted from being scattered around the outside of the air compressor in the front-rear and left-right directions. Also, since the tubular cover covers a surrounding of the discharge pipe end portion in the front-rear and left-right directions, the condensate is further restricted from being scattered around the outside of the air compressor in the front-rear and left-right directions. As a result, the condensate that is discharged into the inside of the tubular cover is restricted from being scattered in the front-rear and left-right directions, thereby discharging the condensate from the lower portion of the tubular cover in the downward direction. Since the discharge pipe end portion extends long in the up-down direction, an opening area of the lower portion of the tubular cover covering the discharge pipe end portion can be made small. As a result, the discharge area of the condensate may be made small, thereby further restricting the condensate from being scattered around the outside of the air compressor.

DETAILED DESCRIPTION

Figure 1:
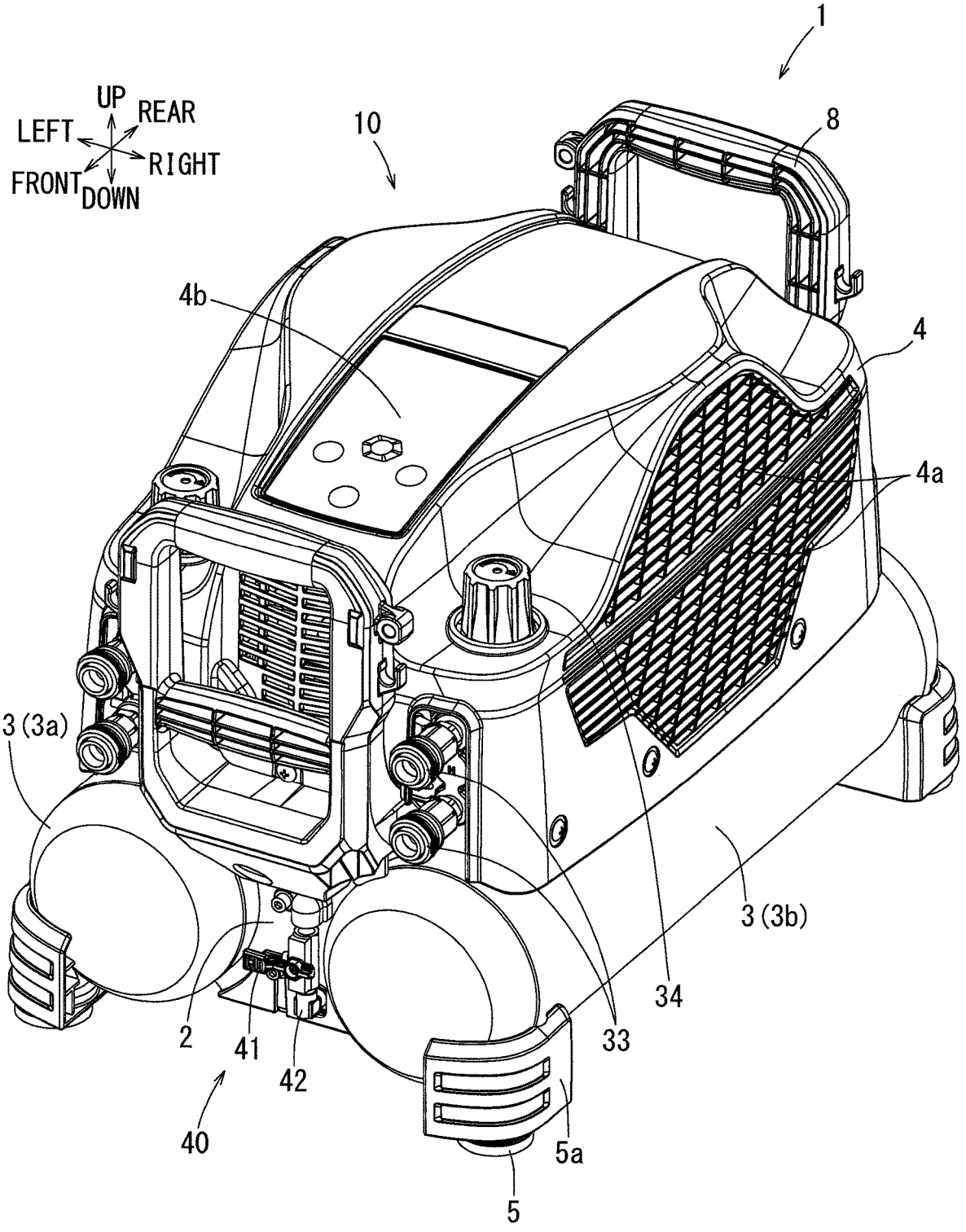
FIG. 1 is a perspective view of an air compressor viewed from the front according to an embodiment of the present disclosure.

The detailed description set forth below, when considered with the appended drawings, is intended to be a description of exemplary embodiments of the present disclosure and is not intended to be restrictive and/or to represent the only embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the disclosure. It will be apparent to those skilled in the art that the exemplary embodiments of the disclosure may be practiced without these specific details. In some instances, these specific details refer to well-known structures, components and/or devices that are shown in block diagram form in order to avoid obscuring significant aspects of the exemplary embodiments presented herein.

According to one aspect of the present disclosure, the air compressor may include a lower cover that covers an opening of the tubular cover, the opening of the tubular cover facing downward. Accordingly, after the condensate is discharged to the inside of the tubular cover and drops down to the upper surface and the outer peripheral surface of the lower cover, the condensate is discharged from the outer peripheral edge of the lower cover in the downward direction. As a result, the discharge area of the condensate is restricted to a narrow area around the outer peripheral edge of the lower cover.

According to one aspect of the present disclosure, the air compressor may include a muffling member that is housed in an inside of the tubular cover. The muffling member may be structured to cover an area surrounding of the discharge port of the discharge pipe end portion. Accordingly, the strength of the compressed air and the condensate discharged from the discharge port can be reduced by the muffling member. As a result, a loud noise that could be otherwise be generated when the compressed air is rapidly discharged from the discharge port of the discharge pipe end portion is reduced. Also, the condensate is further restricted from being scattered around the air compressor. Furthermore, the lower cover may be configured to retain the muffling member in the inside of the tubular cover, so as to prevent the muffling member from being blown out.

According to one aspect of the present disclosure, the muffling member is metal wool. Thus, the muffling member has high strength. Accordingly, when the compressed air and the condensate are discharged from the discharge port, the muffling material is restricted from being deformed. As a result, this may prevent the performance of the muffling member for reducing the strength of the compressed air and the condensate from deteriorating, in comparison with an initial performance at the time of product shipment. Since the muffling member may be a wool-like fiber member, the condensate introduced into the muffling member can be easily discharged to the outside of the muffling material. Accordingly, the condensate may be fully discharged, thereby reducing the amount of condensate that remains inside of the tubular cover.

According to one aspect of the present disclosure, the lower cover may include a support portion that is configured to support the muffling member from below. Because of this configuration, the support portion retains the muffling member within the tubular cover. As a result, the muffling member is prevented from being blown out of the tubular cover when the condensate flows out of the tubular cover.

According to one aspect of the present disclosure, the lower cover may include a plurality of protrusions that are formed in the support portion and that protrude upward. The lower cover may also include a plurality of discharge grooves, each of which is formed between adjacent protrusions and serves to guide the condensate in an outer peripheral direction. The plurality of protrusions may be structured to retain the muffling material above the lower cover such that the muffling material does not fall down. Thus, a gap may be maintained between the upper surface of the lower cover and the muffling material. As a result, the condensate introduced into the muffling material more easily flows downward through the gap. Furthermore, the condensate may be more efficiently discharged toward the outer peripheral edge of the lower cover by traveling along the discharge groove. As a result, the condensate may be discharged such that the discharge area of the condensate may be made small and the condensate may be prevented from remaining in the inside of the tubular cover.

According to one aspect of the present disclosure, the lower cover may be connected to the tubular cover. The lower cover and the tubular cover may be connected so as to form a discharge channel between the outer peripheral surface of the lower cover and the bottom portion of the tubular cover. Thus, the condensate may be discharged in a relatively more narrow area between the outer peripheral edge of the lower cover and a lower outer peripheral edge of the bottom portion of the tubular cover.

According to one aspect of the present disclosure, the lower cover may include an outer peripheral surface configured to be tilted downward and have a lower portion that is structured in a tapered shape extending radially outward toward an outer peripheral edge. Thus, the condensate may be more efficiently discharged toward the outer peripheral edge of the lower cover by traveling along the tilted outer peripheral surface of the lower cover. As a result, the condensate is prevented from remaining in an area between the upper surface and the outer peripheral surface of the lower cover.

According to one aspect of the present disclosure, the tubular cover may include a bottom portion that is configured to be tilted downward in a tapered shape extending radially outward so as to face the tapered outer peripheral surface of the lower cover. Thus, the portion of the discharge channel between the tapered outer peripheral surface and the tapered bottom portion is configured to have a specified height. As a result, the condensate is efficiently discharged toward the outer peripheral edge of the lower cover. Furthermore, since the bottom portion may be arranged relatively close to the outer peripheral surface, the muffling member can remain within the tubular cover without being blown out of the tubular cover.

According to one aspect of the present disclosure, the air compressor may include a plurality of tanks, and the discharge pipe end portion of the discharge pipe and the tubular cover may be disposed between this plurality of tanks. Because of this configuration, the discharge pipe end portion of the discharge pipe and the tubular cover are arranged so as to utilize a space between the plurality of tanks. As a result, the air compressor can be made more compact.

A representative, non-limiting embodiment according the present disclosure will be described with reference to FIGS. 1 to 8. As shown in FIG. 1, an air compressor 1 may include approximately two tubular-shaped tanks 3. The tubular tanks 3 may extend in a front-rear direction. The two tanks 3 may be disposed side by side in a left-right direction and may be combined at front and rear locations via a base 2. An air compressor main body 10 may be disposed above the two tanks 3. The air compressor main body 10 may be covered by approximately a box-shaped main body cover 4 that has an opening at its lower side. A support leg 5 may be disposed at each lower portion of the front and the rear of each two tanks 3. Four support legs 5 in total may support the two tanks 3 and the air compressor main body 10, thereby allowing the air compressor 1 to more easily be placed on an installation surface F, such as, for example, a ground or a floor surface (refer to FIG. 4). In the following explanations, up and down directions may be defined such that a side of the air compressor 1 facing an installation surface F may be referred to as a downward side. Front and rear directions may be defined such that a side of the air compressor 1 with a drain cock, which will be discussed in detail later, is referred to as a front side. Left and right directions may be based on the case where the air compressor 1 is viewed from the front.

As shown in FIG. 1, a plurality of ventilation holes 4*a* formed in a mesh shape may be arranged on front, rear, left, and right sides of the main body cover 4. Outside air may be introduced to the air compressor main body 10 via the plurality of ventilation holes 4*a*. An operation panel 4*b* for operating the air compressor 1 may be arranged on an upper portion of the main body cover 4. The operation panel 4*b* may be electrically connected to electrical components of the air compressor main body 10. Operating a button on the operation panel 4*b* may, for example, start and/or stop the air compressor 1. A handle 8 may extend upward and be formed in a loop shape. One handle 8 may be arranged in front of the main body cover 4 and one handle 8 may be arranged at a rear portion of the main body cover 4. In some embodiments, the two handles 8 may be connected to both the main body cover 4 and the base 2. A user may easily carry the air compressor by holding the two handles 8.

As shown in FIG. 1, a tank guard 5*a* may be arranged at each front and rear end of two tanks 4. A tank guard 5*a* may be disposed above each of the support legs 5. Each tank guard 5*a* may extend in an up-down direction and its outer peripheral surface may be curved in a circular arc shape in a plan view. The tank guards 5*a* may cover and protect each corner at the front and rear ends of the tanks 3 and each support leg 5 from outside impact.

Figure 2:
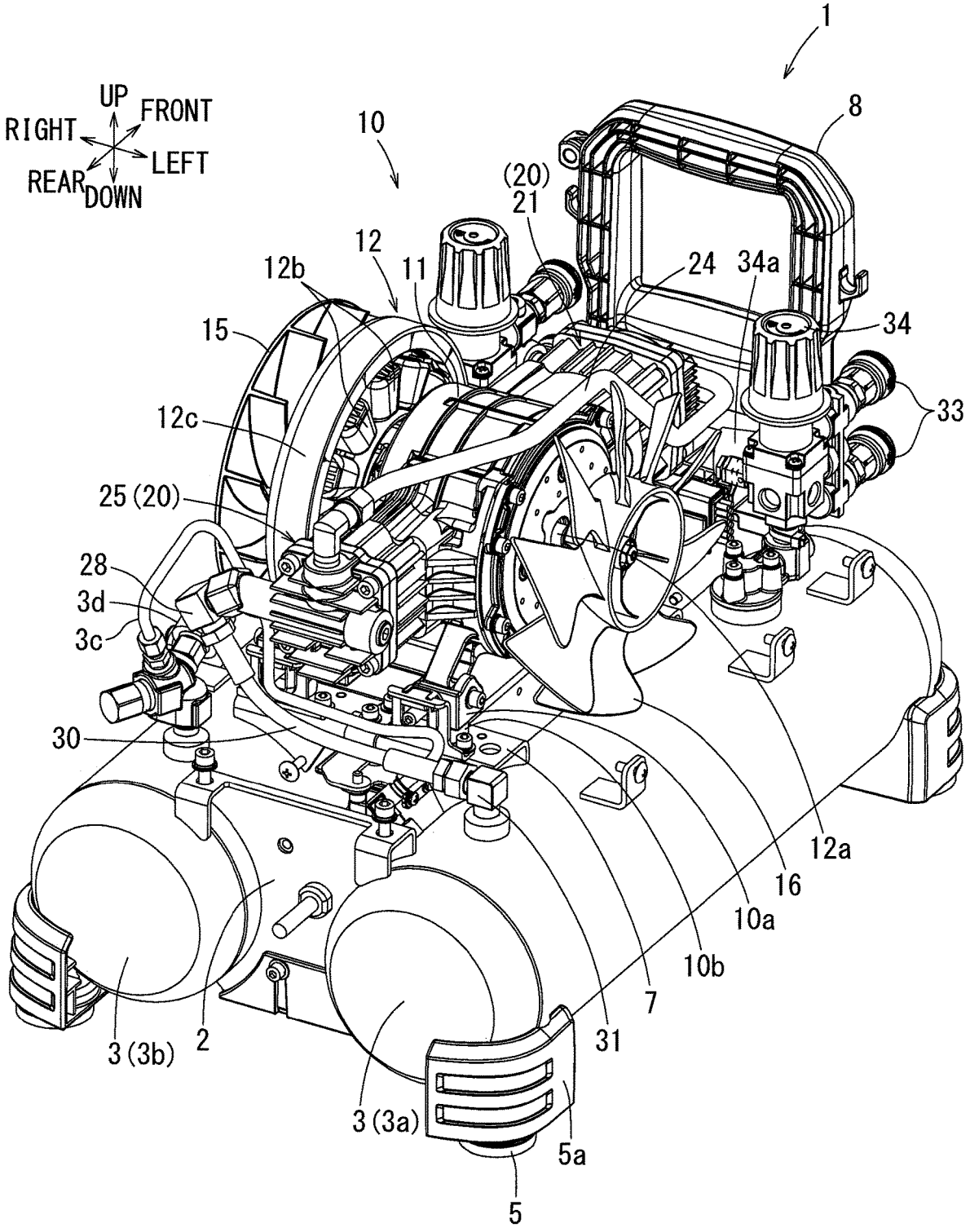
FIG. 2 is a perspective view of the air compressor viewed from the rear, with a main body cover removed therefrom.
Figure 3:
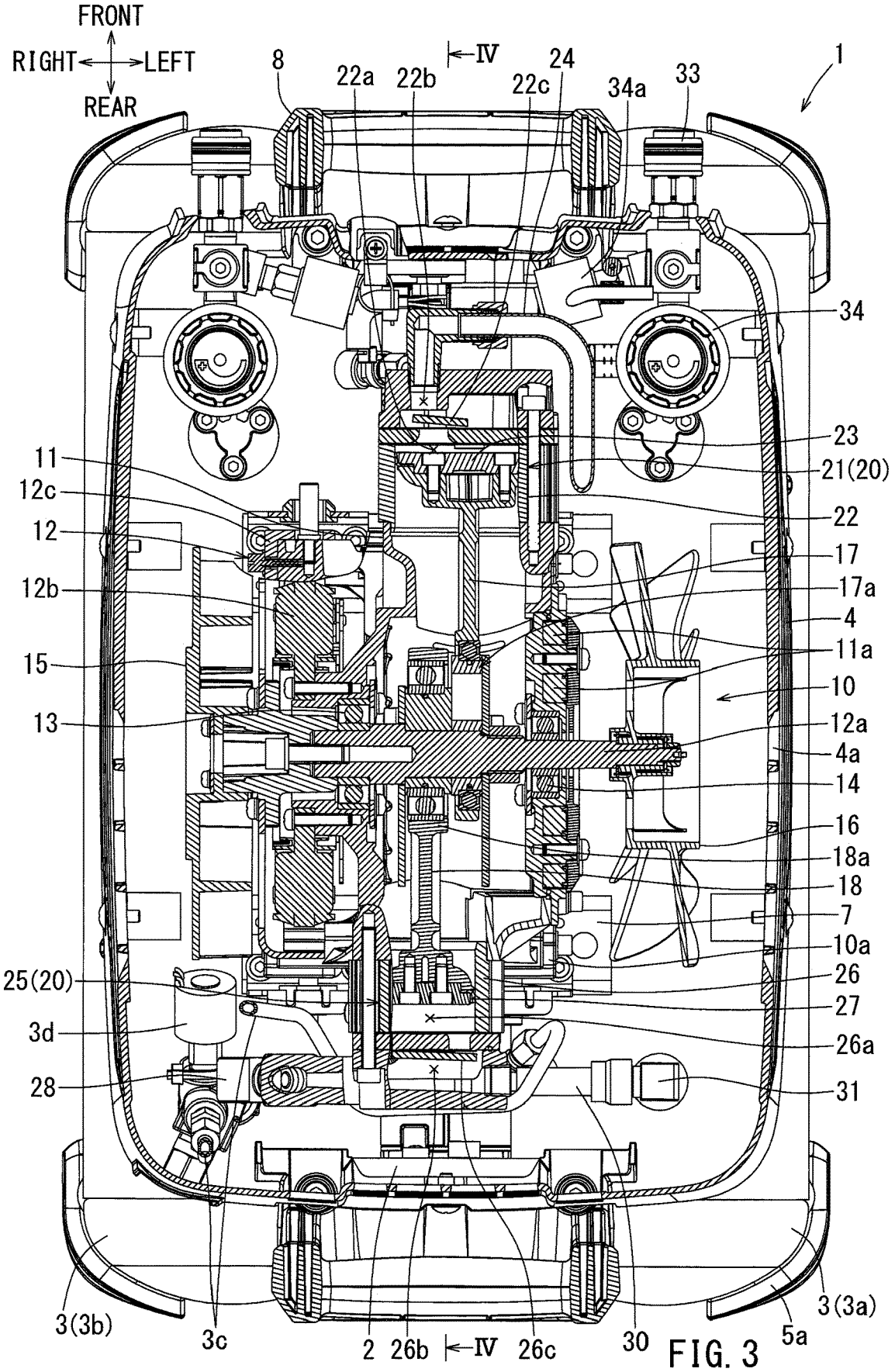
FIG. 3 is a lateral cross-sectional view of the air compressor viewed from above.

As shown in FIGS. 2 and 3, the compressor main body 10 may include a compressor 20 that generates compressed air and an electric motor 12 that drives the compressor 20. The compressor 20 may be housed within an inner case 11. The electric motor 12 may be an outer rotor type brushless motor. The electric motor 12 may include an output shaft 12*a* horizontally extending in the left-right direction. The output shaft 12*a* may pass through the inner case 11 and may be rotatably supported by bearings 13, 14 within the inner case 11. A cylindrical rotor 12*c*, which may be integrally connected to the output shaft 12*a*, may be disposed on the right side of the inner case 11. A plurality of stators 12*c* with wound coils may be disposed on a radially inner circumferential side of the rotor 12*c*. The plurality of stators 12*b* may be arranged at approximately equal intervals in a circumferential direction of the output shaft 12*a*. When electric power is supplied to the electric motor 12, the output shaft 12*a* and the rotor 12*c* may rotate around an axis of the output shaft 12*a*.

As shown in FIGS. 2 and 3, a fan 15 may be attached to a right end of the output shaft 12*a*. When the fan 15 rotates integrally with the output shaft 12*a*, the fan 15 may generate motor cooling air flowing from a left side of electric motor 12 to an area radially outside of the fan 15. Another fan 16 may be attached to a left end of the output shaft 12*a*. As shown in FIG. 2, the left side of the inner cover 11 may include a plurality of holes (unsigned) on a right side of the fan 16, and a filter 11*a* may cover each of the plurality of holes as shown in FIG. 3. The filter 11*a* may prevent dust and/or chips from entering into the inner case 11. When the fan 16 rotates integrally with the output shaft 12*a*, outside air may flow from the left side of the fan 16 to the right side of the filters 11*a*. The outside air may be introduced to the inside of the inner case 11 via the filters 11*a*.

As shown in FIG. 3, the compressor 20 may have a two-staged compressor mechanism including a first compressor 21 and a second compressor 25. The first compressor 21 may include a first cylinder 22 that is disposed in front of the output shaft 12*a* and extends in a front-rear direction. The first compressor 21 may also include a first piston 23 that reciprocates inside of the first cylinder 22. The second compressor 25 may include a second cylinder 26 that is disposed behind the output shaft 12*a* and extends in the front-rear direction. The second compressor 25 may also include a second piston 27 that reciprocates inside of the second cylinder 26.

As shown in FIG. 3, a first crank disc 17*a* may be linked to the output shaft 12*a*, with a center of the first crank disc 17*a* being offset with respect to the center of the output shaft 12*a*. Similarly, a second crank disc 18*a* may be linked to the output shaft 12*a*, with a center of the second crank disc 18*a* being offset with respect to the center of the output shaft 12*a*. A first crank rod 17 may extend straight to be radially outside of the first crank disc 17*a*. The first piston 23 may be linked to a tip portion of the first crank rod 17. A rotational movement of the first crank disc 17*a* around the output shaft 12*a* may be converted to a reciprocating movement of the first piston 23 by the first crank rod 17. Accordingly, the first piston 23 may reciprocate in the front-rear direction, which is a direction in which the first cylinder 22 extends. Similar to the first crank rod 17, a second crank rod 18 may extend straight to be radially outside of the second crank disc 18*a*. The second piston 27 may be linked to a tip portion of the second crank rod 18. A rotational movement of the second crank disc 18*a* around the output shaft 12*a* may be converted to a reciprocating movement of the second piston 27 by the second crank rod 18. Accordingly, the second piston 27 may reciprocate in the front-rear, which is a direction in which the second cylinder 26 extends.

As shown in FIG. 3, a first piston chamber 22*a* may be formed through the cooperation of the first cylinder 22 and the first piston 23. A communication passage (unsigned) through which air may pass may be disposed between the first piston chamber 22*a* and a center portion (unsigned) of the inner case 11. The center portion of the inner case 11 may have filters 11*a*. Thus, outside air may be introduced to the inside of the first piston chamber 22*a* via the filters 11*a*. A first intermediate chamber 22*b* may be airtightly formed in front of the first piston chamber 22*a*. A first check valve 22*c* that prevents air backflow from the first intermediate chamber 22*b* to the first piston chamber 22*a* may be disposed between the first piston chamber 22*a* and the first intermediate chamber 22*b*. In the first compressor 21, the pressure of the air taken from outside may be increased to a first pressure, such as, for example, 0.7 to 1 MPa (mega Pascal).

As shown in FIG. 3, a second piston chamber 26*a* may be formed through the cooperation of the second cylinder 26 and the second piston 27. The second piston chamber 26*a* may be airtight with respect the center portion of the inner case 11 having the filters 11*a*. Furthermore, the second piston chamber 26*a* may communicate with the first intermediate chamber 22*b* via a communication pipe 24. Because of this configuration, the compressed air generated in the first compressor 21 may be supplied to the second piston chamber 26*a*. A second intermediate chamber 26*b* may be airtightly formed below the second piston chamber 26*a*. A second check valve 26*c* that prevents air backflow from the second intermediate chamber 26*b* to the second piston chamber 26*a* may be disposed between the second piston chamber 26*a* and the second intermediate chamber 26*b*. In the second compressor 25, the air pressure of the compressed air generated in the first compressor 21 may be further increased to a second pressure, such as, for example, 3 to 4.5 MPa (mega Pascal).

As shown in FIGS. 2 and 3, the air compressor 1 may include a first tank 3*a* and a second tank 3*b*. The second intermediate chamber 26*b* may communicate with an output port 28, from which the compressed air is to be discharged. The first tank 3*a* may communicate with an input port 31, from which compressed air is to be taken. The compressed air may be sent from the second compressor 25 to the first tank 3*a* via a communication pipe 30, through which the output port 28 and the input port 21 are in communication. The first tank 3*a* may communicate with the second tank 3*b* via a tank communication pipe 3*c*. The pressure of the compressed air sent from the first tank 3*a* to the second tank 3*b* may be detected by a pressure sensor 3*d* attached to the tank communication pipe 3*c*.

As shown in FIGS. 1 and 2, a plurality of joints 33 for suppling compressed air to, for example, an air-powered tool may be disposed at the front of the compressor main body 10. The joints 33 may communicate with the tank 3, such that the compressed air stored within the tank 3 can be discharged therethrough. The joints 33 may protrude outside of the main body cover 4, so as to be more easily connected to an air hose. An adjusting knob 34 for adjusting a pressure-reducing-valve, which communicates with the joints 33, may be disposed on an upper front side of the compressor main body 10. The adjusting knob 34 may protrude from an upper surface of the main body cover 4, so as to be more easily operated from outside of the main body cover 4. The pressure of the compressed air discharged from the joints 33 may be adjusted to an operating pressure of the air-powered tool through rotation of the adjusting knob 34. The pressure of the compressed air adjusted by the adjusting knob 34 may be detected by a pressure sensor 34*a*.

Figure 4:
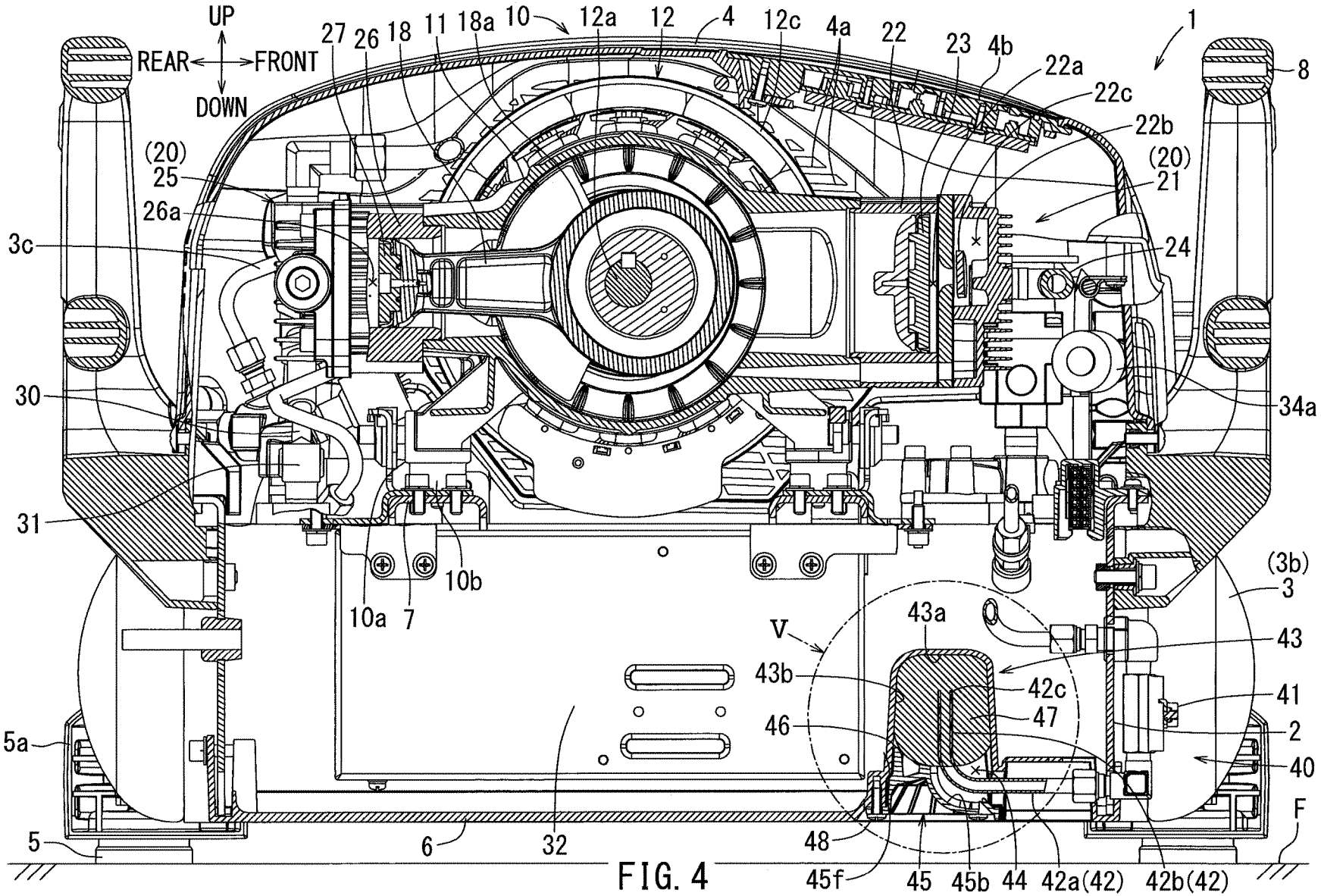
FIG. 4 is a cross-sectional view taken along line IV-IV of FIG. 3.

As shown in FIGS. 2 and 4, a front main body support member 7 and a rear main body support member 7, both of which may be used for connecting the two tanks 3 in the left-right direction, may be disposed on an upper surface of the two tanks 3. Accordingly, two main body support members 7 may be used for connecting the two tanks 3. Furthermore, as shown in FIG. 4, a vibration absorbing member 10*b*, which may be made of, for example, rubber, may be attached to an upper surface of the main body support member 7. The vibration absorbing member 10*b* may be disposed on the left and right sides of the front main body support member 7, as well as on the left and right sides of the rear main body support member 7. Thus, four vibration absorbing members 10*b* may be disposed in total. Four main body legs 10*a*, which are integrally formed with the inner case 11, may be respectively linked to a corresponding upper surface of the four vibration absorbing members 10*b*. The compressor main body 10 may be supported above the two tanks 3 in this manner. Because of this configuration, vibration caused by driving of the compressor 20 may be reduced by the vibration absorbing members 10*b*. As a result, vibration of the tank 4 may be suppressed.

As shown in FIG. 4, a controller 32 may be disposed below the compressor main body 10. The controller 32 may be housed in a shallow case formed in a rectangular box shape. The controller 32 may be supported below the front and rear main body support members 7, such that a longitudinal direction of the controller 32 is aligned with the front-rear direction and a width direction of the controller 32 is aligned with the left-right direction. The controller 32 may control supplying electric power to and driving of the electric motor 12, etc. based on, for example, control signals transmitted from the operation panel 4*b* and/or signals from the pressure sensor 3*d*. An underguard 6 may be disposed below the controller 32 and between the two tanks 3. The underguard 6 may be formed in a rectangular plate shape. The underguard 6 may cover a lower portion of the controller 32.

Figure 7:
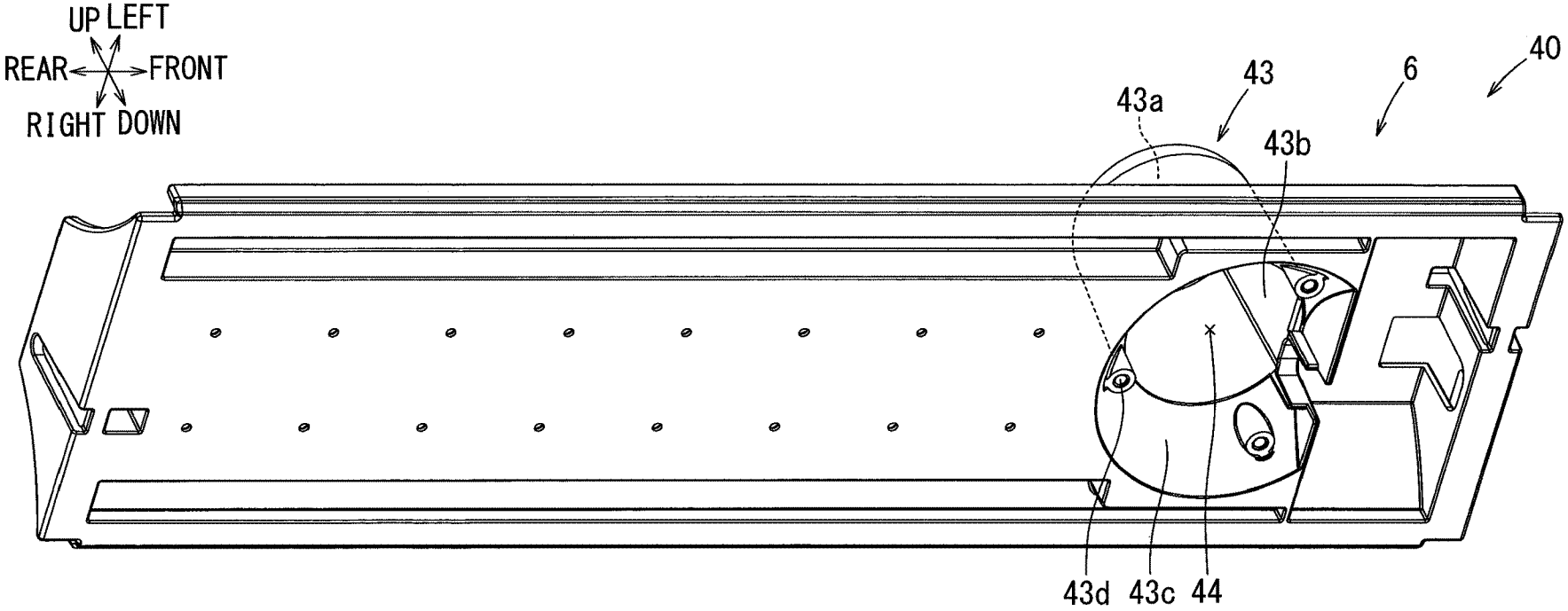
FIG. 7 is a perspective view of an underguard viewed from below.

As shown in FIGS. 4 and 7, a tubular cover 43, which may have substantially an annular cross section in a plan view, may be integrally formed at a front portion of the underguard 6. The tubular cover 43 may be formed in the middle of the underguard 6 in the left-right direction. Accordingly, the tubular cover 43 may be disposed between the two tanks 3 in the left-right direction. The tubular cover 43 may extend upward from the underguard 6 and may be formed in a shape of a tube whose upper end is closed. The tubular cover 43 may include a top portion 43*a* formed in nearly a disc shape, a peripheral side portion 43*b* extending in the up-down direction, and a bottom portion 43*c* that includes a tapered tilted surface. An upper portion of the peripheral side portion 43*b* may be combined with an outer peripheral edge of the top portion 43*a*. A lower end portion of the peripheral side portion 43*b* may be combined with an upper end portion of the bottom portion 43*c*. The bottom portion 43*c* of the tubular cover 43 may extend (tilt) radially outward in a downward direction from the lower end portion of the peripheral side portion 43*b*. A plurality of screw holes 43*d* may be formed in the bottom portion 43*c*. The plurality of screw holes 43*d* may extend in the up-down direction and a surrounding of each of the screw holes 43*d* may be covered by a boss part. An outer peripheral edge of the bottom portion 43*c* may be connected to the underguard 6. A front portion of the underguard 6 and a rear portion of the underguard 6 may be screw-connected to the base 2, such that the underguard 6 straddles the gap between the two tanks 3 in the left-right direction.

As shown in FIG. 4, the air compressor 1 may include a condensate discharge section 40. The condensate discharge section 40 may be structured for discharging compressed air and a condensate from the inside of the two tanks 3. The condensate discharge section 40 may include a discharge pipe 42 extending from the tanks 3 and a drain cock 41 that serves to open and close the discharge pipe 42. The compressed air and the condensate may be discharged from the discharge pipe 42. The drain cock 41 may be disposed along a passage of the discharge pipe 42. As shown in FIG. 4, the portion of the discharge pipe 42 extending from the tanks 3 may at first extend downward along the front-side base 2. The drain cock 41 may be disposed on a front surface of the front-side base 2. When the drain cock 41 is closed, the compressed air and the condensate in the tank 3 may not be discharged from the discharge pipe 42. When the drain cock 41 is open, the compressed air and the condensate in the tank 3 may be discharged from a discharge port 42*c* of the discharge pipe 42. The speed at which this is done may be in accordance with the opening degree of the drain cock 41.

Figure 5:
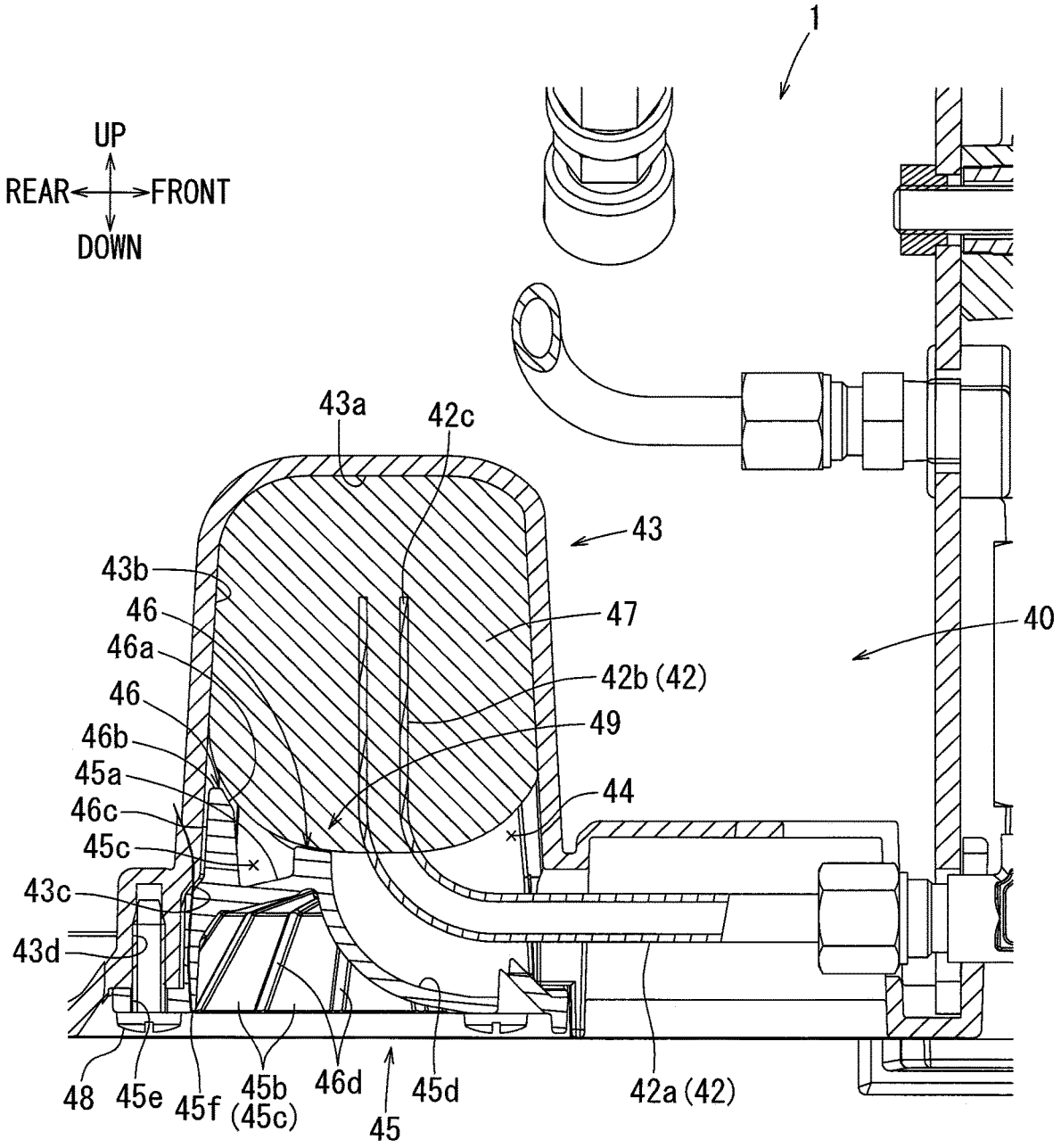
FIG. 5 is an enlarged view of a part V of FIG. 4.

As shown in FIGS. 4 and 5, the discharge pipe 42 may include a horizontal extending portion 42*a* that extends rearward from around a lower end of the base 2 and may extend below a portion of the underguard 6. The horizontal extending portion 42*a* may extend to approximately a midpoint of the tubular cover 43 in the front-rear direction. The discharge pipe 42 may also include a discharge pipe end portion 42*b* extending upward from a lower portion the tubular cover 43. The discharge pipe end portion 42*b* may be disposed approximately in a middle portion of the tubular cover 43 and may extend in the up-down direction. The discharge port 42*c* may be formed at an upper end of the discharge pipe end portion 42*b*. The discharge port 42*c* may open upwards and face the top portion 43*c* of the tubular cover 43

As shown in FIGS. 4 and 5, the condensate discharge section 40 may include a tubular muffling chamber 44, into which the discharge pipe end portion 42*b* is inserted. The muffling chamber 44 may be formed through the cooperation of the tubular cover 43 and a lower cover 45 that is connected to the bottom portion 43*c* of the tubular cover 43. A muffling member 47 may be housed in the muffling chamber 44. The muffling member 47 may be a wool-like fiber member, for instance a metal wool configured of fine fiber members mutually intertwined. For example, the muffling member 47 may be steel wool made from steel, or stainless wool made from stainless steel. The muffling member 47 may include numerous minute gaps (microgaps), thereby dispersing the flow of air passing therethrough. Furthermore, the muffling member 47 may have very high permeability (e.g., drainability) and may have extremely low absorbency (e.g., water retentivity). The muffling member 47 may be housed in such a manner that the muffling chamber 44 is largely packed with the muffling member 47. The muffling member 47 may be positioned within the muffling chamber 44 to cover at least the area surrounding of the discharge port 42*c* of the discharge pipe end portion 42*b*.

Figure 8:
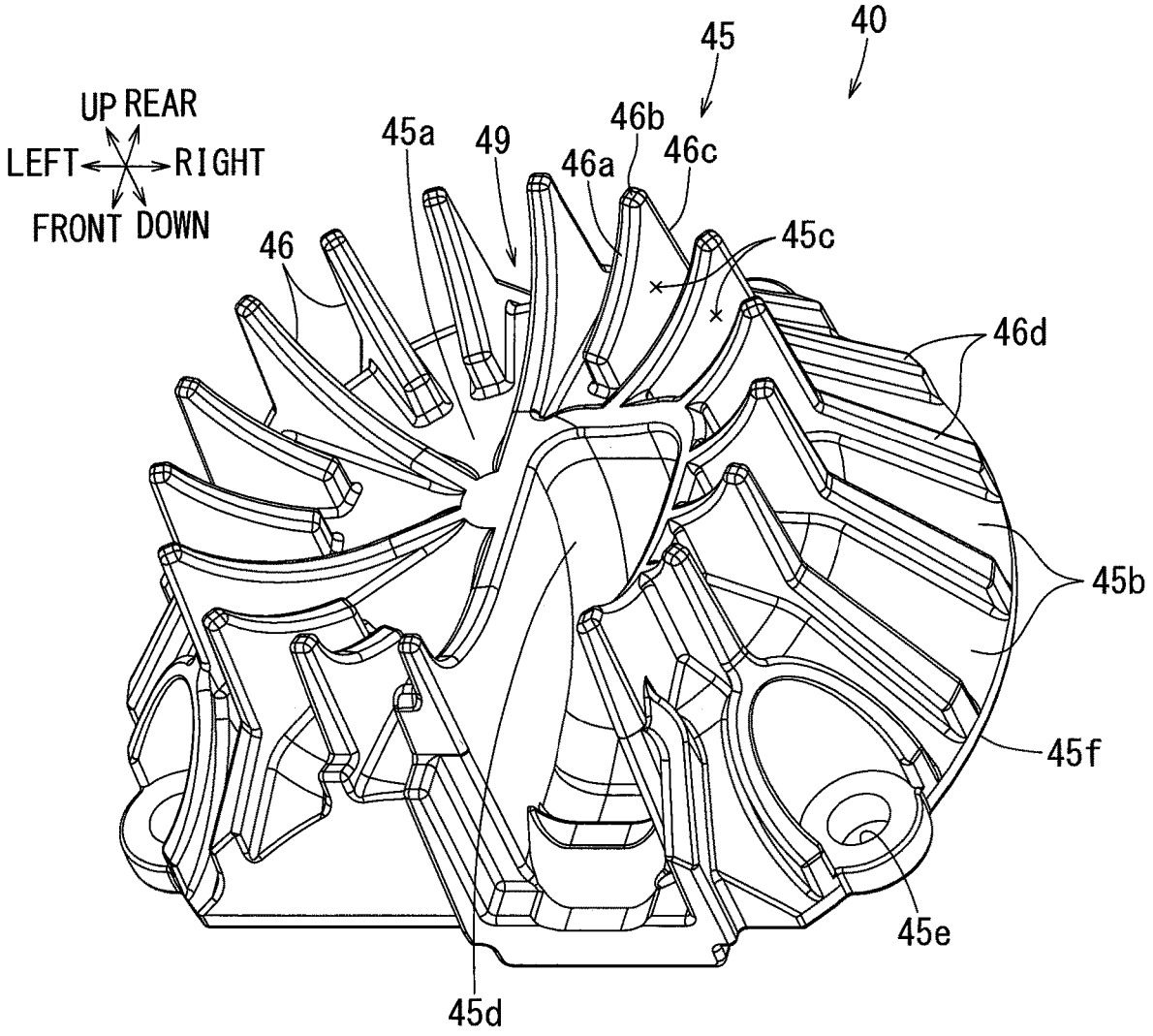
FIG. 8 is a perspective view of a lower cover viewed from above.

As shown in FIGS. 5 and 8, the lower cover 45 may be formed in approximately a truncated cone shape so as to cover a lower opening of the tubular cover 43. The lower cover 45 may include an upper surface 45*a* and an outer peripheral surface 45*b*. The upper surface 45*a* may be disposed to be nearly horizontal and may have roughly a circular shape. The outer peripheral surface 45*b* may extend radially outward and in the downward direction from an outer peripheral edge of the upper surface 45*a*. The outer peripheral surface 45*b* may be tilted downward and a lower portion of the lower cover 45 may have a tapered shape extending radially outside toward an outer peripheral edge 45*f*. A tilt angle of the outer peripheral surface 45*b* may be nearly the same as that of the bottom portion 43*c* of the tubular cover 43. Because of this configuration, when the lower cover 45 is attached to the tubular cover 43, the outer peripheral surface 45*b* and the lower cover 43*c* may face each other.

As shown in FIGS. 5 and 8, the lower cover 45 may include a recessed portion 45*d* at a front upper portion thereof. The recessed portion 45*d* may extend from a front end of the lower cover 45 to approximately a center of the lower cover 45. The recessed portion 45*d* may include an arc-shaped wall, as viewed from the left-right direction. A bent portion of the discharge pipe 42, which is a portion at which the horizontal extending portion 42*a* is coupled to the discharge pipe end portion 42*b* so that they form an L shape, may be disposed in the recessed portion 45*d*. Because of this configuration, the discharge pipe 42, the discharge pipe end portion 42*b* of which extends from the front-side base 2 toward the rear-side of the lower cover 45, may be introduced to the upper-side of the muffling chamber 44. A support portion 49 for supporting the muffling member 47 from below may be formed on an upper portion of the lower cover 45.

As shown in FIG. 8, the support portion 49 may include a plurality of protrusions 46 that protrude upward from both the upper surface 45*a* and the outer peripheral surface 45*b*. Each of the plurality of protrusions 46 may be formed in a plate shape standing upward and may extend radially upward of the upper surface 45*a* of the lower cover 45. The plurality of protrusions 46 may be formed at predetermined intervals in the peripheral direction of the lower cover 45. A plurality of discharge grooves 45*c* may be formed such that each of the discharge grooves 45*c* is formed between adjacent protrusions 46 and extends radially outward. The condensate that drops down to the upper surface 45*a* and the outer peripheral surface 45*b* may be guided to the outer peripheral edge 45*f* of the lower cover 45 by flowing along the plurality of discharge grooves 45*c*.

As shown in FIGS. 5 and 8, each of the plurality of protrusions 46 may include an upper end 46*b* positioned so as to be above an outer peripheral edge of the upper surface 45*a*. Also, each of the protrusions 46 may include an arc-shaped upper surface 46*a* extending radially from nearly a center portion of the upper surface 45*a* to the upper end 46*b* of the protrusion 46. The arc-shaped upper surface 46*a* may have an arc shape. The muffling member 47, which may be housed in the upper portion of the muffling chamber 44, may be supported from below through the cooperation of the plurality of arc-shaped upper surfaces 46*a*. Each of the protrusions 46 may include a standing surface 46*c* extending from the upper end 46*b* of the protrusion 46 downward in the up-down direction. Also, each of the protrusions 46 may include an outer peripheral protrusion 46*d* that extends radially outward and in the downward direction from a lower end of each of the standing surface 46*c*. As shown in FIG. 8, each of the outer peripheral protrusions 46*d* may extend above and along the outer peripheral surface 45*b* and may extend toward the outer peripheral edge 45*f* in the downward direction. Because of this configuration, the outer peripheral protrusion 46*d* may be formed to have substantially a uniform height from the outer peripheral surface 45*b*.

As shown in FIGS. 5 and 8, the outer peripheral surface 45*b* may include a plurality of insertion holes 45*e*, each of which surrounds a boss part and extends in the up-down direction. The lower cover 45 may be attached to a lower portion of the tubular cover 43 by inserting a stop screw 48 into the screw hole 45*e* to screw-connect the screw hole 45*e* to the corresponding screw hole 43*d* of the bottom portion 43*c* of the tubular cover 43.

As discussed above, the air compressor 1 may include the compressor 20 that compresses introduced air and the tank 3 that stores the compressed air generated by the compressor 20. The air compressor 1 may include the discharge pipe 42 from which the compressed air and the condensate in the tank 3 may be discharged to the outside of the tank 3. The air compressor 1 may also include the drain cock 41 that is disposed at a point along the passage of the discharge pipe 42 and serves to open and close the discharge pipe 42. The air compressor 1 may also include the discharge pipe end portion 42*b* which includes the discharge port 42*c* facing upward at a tip end of the discharge pipe 42. Furthermore, the air compressor 1 may include the tubular cover 43 having the top portion 43*a* that covers the discharge pipe end portion 42*b* from above.

Because of this configuration, the compressed air and the condensate may be discharged (in a direction against gravity) toward the inside of the tubular cover 43 from the discharge port 42*c* facing upward. The top portion 43*a* of the tubular cover 43 may serve to restrict the condensate from being discharged above the top portion 43*a*. Since the condensate is discharged upward from the discharge port, the condensate may be restricted from being scattered around the outside of the air compressor 1 in the front-rear and left-right directions. Also, since the tubular cover 43 covers a surrounding of the discharge pipe end portion 42*b* in the front-rear and left-right directions, the condensate may be further restricted from being scattered around the outside of the air compressor 1 in the front-rear and left-right directions. As a result, the condensate that is discharged into the inside of the tubular cover 43 may be restricted from being scattered in the front-rear and left-right directions, thereby causing the condensate to be discharged only from the lower portion of the tubular cover 43 in the downward direction. Since the discharge pipe end portion 42*b* extends long in the up-down direction, an opening area of the lower portion of the tubular cover 43 covering the discharge pipe end portion 42*b* may be made small. As a result, the discharge area of the condensate may be made small, thereby restricting the condensate from being scattered around the outside of the air compressor 1.

Figure 6:
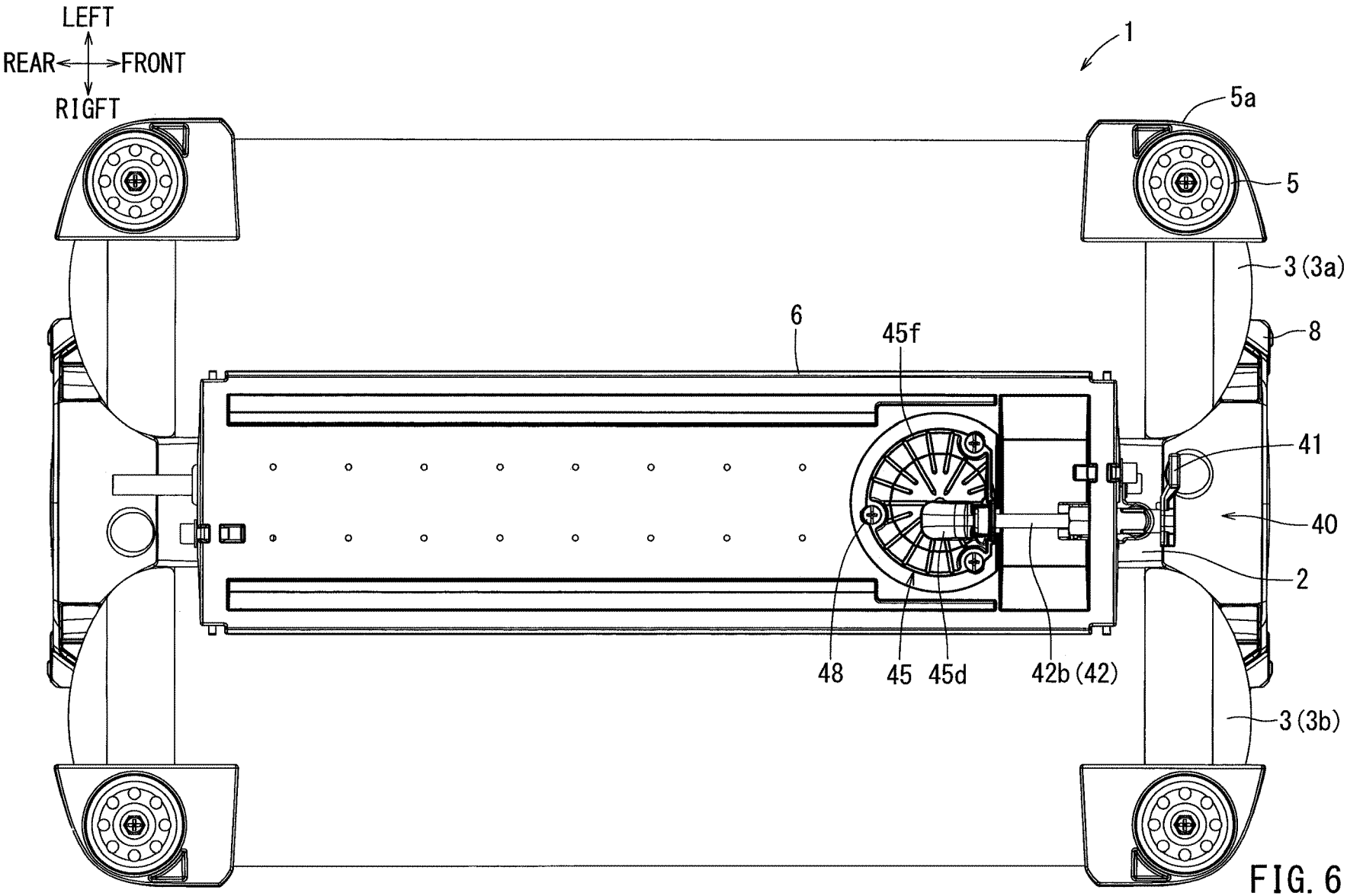
FIG. 6 is a bottom view of the air compressor.

As shown in FIGS. 4 and 6, the air compressor 1 may include the lower cover 45 that covers the opening of the tubular cover 43, the opening the tubular cover 43 facing downward. Accordingly, after the condensate that has been discharged to the inside of the tubular cover 43 drops down to the upper surface 45*a* and the outer peripheral surface 45*b* of the lower cover 45, the condensate may be discharged from the outer peripheral edge 45*f* of the lower cover 45 in the downward direction. As a result, the discharge area of the condensate may be restricted to a narrow area around the outer peripheral edge 45*f*.

As shown in FIGS. 4 and 5, the air compressor 1 may include the muffling member 47 that is housed in the inside of the tubular cover 43. The muffling member 47 may be positioned so as to cover the area surrounding of the discharge port 42*c* of the discharge pipe end portion 42*b*. Accordingly, the strength of the compressed air and the speed at which the condensate is discharged from the discharge port 42*c* may be reduced by the muffling member 47. As a result, a loud noise that could otherwise be generated when the compressed air is rapidly discharged from the discharge port 42*c* of the discharge pipe end portion 42*b* may be reduced. Also, as discussed above, the condensate may be restricted from being scattered around the air compressor 1. Furthermore, the lower cover 45 may retain the muffling member 47 within the tubular cover 43 so as not to be blown out of the tubular cover 43.

As discussed above, the muffling member 47 may be made of metal wool. Thus, the muffling member 47 may have the property of high strength. Accordingly, when the compressed air and the condensate are discharged from the discharge port 42*c*, the muffling material 47 is less likely to be deformed. As a result, the performance of the muffling member 47 in reducing strength of the compressed air and the speed at which the condensate is discharged may be prevented from deteriorating from its initial performance at the time of product shipment. Since the muffling member 47 may be a wool-like fiber member, the condensate introduced into the muffling member 47 may be easily discharged to the outside of the muffling material 47. Accordingly, the condensate may be fully discharged, thereby preventing the condensate from remaining in the inside of the tubular cover 43.

As shown in FIGS. 5 and 8, the lower cover 45 may include the support portion 49, which is configured to support the muffling member 47 from below. Because of this configuration, the muffling member 47 may be retained in the inside of the tubular cover 43. As a result, the muffling member 47 may be prevented from being blown out of the tubular cover 43 when the condensate is discharged from the inside of the tubular cover 43.

As shown in FIGS. 5 and 8, the lower cover 45 may include the plurality of protrusions 46 that are formed as part of the support portion 49 and that protrude upward. The lower cover 45 may also include the plurality of discharge grooves 45*c*, each of which is formed between adjacent protrusions 46 and serves to guide the condensate in the outer peripheral direction. The plurality of protrusions 46 may serve to retain the muffling material 47 above the lower cover 45, so as to prevent the muffling material 47 from falling down. Additionally, this allows a gap to be maintained between the upper surface 45*a* of the lower cover 45 and the muffling material 47. As a result, the condensate introduced into the muffling material 47 may easily flow downward through the gap. Furthermore, the condensate may be discharged toward the outer peripheral edge 45*f* of the lower cover 45 by flowing along the discharge grooves 45*c*. As a result, the condensate may be discharged such that the discharge area of the condensate may not be increased and the condensate may be prevented from remaining in the inside of the tubular cover 43.

As shown in FIG. 5, the lower cover 45 is connected to the tubular cover 43. The connection of the lower cover 45 to the tubular cover 43 may form a discharge channel between the outer peripheral surface 45*b* of the lower cover 45 and the bottom portion 43*c* of the tubular cover 43. Thus, the condensate may be discharged such that the discharge area of the condensate, which may be a relatively narrow area between the outer peripheral edge 45*f* of the lower cover 45 and a lower outer peripheral edge of the bottom portion 43*c* of the tubular cover 43, may not be increased.

As shown in FIGS. 5 and 8, the outer peripheral surface 45*b* of the lower cover 45 may be tilted downward so that the lower portion of the lower cover 45 has the tapered shape extending in a direction radially toward the outer peripheral edge 45*f*. Thus, the condensate may be efficiently discharged toward the outer peripheral edge 45*f* of the lower cover 45 by flowing along the tapered outer peripheral surface 45*b* of the lower cover 45. As a result, the condensate may be prevented from remaining in the space between the upper surface 45*a* and the outer peripheral surface 45*b* of the lower cover 45.

As shown in FIG. 5, the bottom portion 43*c* of the tubular cover 43 may be tilted downward in a tapered shape extending radially outward, facing and extending along the tilted outer peripheral surface 45*b* of the lower cover 45. Thus, the discharge channel positioned between the tilted outer peripheral surface 45*b* and the tapered bottom portion 43*c* may have a fixed height. As a result, the condensate may be efficiently discharged toward the outer peripheral edge 45*f* of the lower cover 45. Furthermore, since the bottom portion 43*c* is arranged relatively close to the outer peripheral surface 45*b*, the muffling member 47 may be retained in the inside of the tubular cover 43 and be prevented from being blown out of the tubular cover 43.

As shown in FIG. 6, the air compressor 1 may include a plurality of tanks 3. The discharge pipe end portion 42*b* of the discharge pipe 42 and the tubular cover 43 may be disposed between the plurality of tanks 3. Because of this configuration, the discharge pipe end portion 42*b* of the discharge pipe 42 and the tubular cover 43 may be arranged to utilize a space between the plurality of tanks 3. As a result, the air compressor 1 may be made compact.

The air compressor 1 according to the embodiment discussed above may be modified in various ways. In the above embodiment, the discharge pipe end portion 42*b* of the discharge pipe 42 may extend approximately vertically (in the upward direction) and the discharge port 42 may open upward. However, the discharge pipe end portion may be tilted, for example, at an angle of 60 to 90° to a horizontal line. Furthermore, an opening direction of the discharge port 42*c* may be tilted, for example, at an angle of 0 to 30° to a vertical line.

In the above embodiment, the tubular cover 43 has substantially an annular cross section. Instead, a tubular cover may have an oval or polygon cross section. Furthermore, instead of the flat-shaped top portion 43*a* of the tubular cover 43, a hemispherical or conical top portion may be used.

In the above embodiment, the muffling member 47 may be made from steel or stainless wool. However, the muffling member 47 may be made from other metal materials resistant to rust. Instead, the muffling member 47 may be a so-called glass wool made from glass fiber. Furthermore, the muffling member 47 may not be limited to a fibrous member. For example, the muffling member 47 may be made of a minute porous material formed by sintered small metal balls.

In the above embodiment, the plurality of protrusions 46 may be arranged to radiate outward from the center portion of the lower cover 45 toward the outer peripheral edge 45*f*, thereby arranging the plurality of discharge grooves 45*c* between the protrusions 46 extending radially outward from the center of the lower cover 45 toward the outer peripheral edge 45*f*. Instead, the location from which the plurality of protrusions 46 and the discharge grooves 45 radially extend may be offset from the center portion of the lower cover 45. For example, the location may be offset toward the rear side, which may increase a quantity of the condensate flowing on the rear side.

In the above embodiment, the air compressor 1 may include two tanks 3 disposed side by side in the left-right direction. Instead, the air compressor 1 may include one tank or more than two tanks. The plurality of tanks 3 may be arranged vertically in the up-down direction or in a mountain shape. Furthermore, in the above embodiment, the compressor 20 uses the two-staged compressor mechanism. Instead, a one-staged or three-staged compressor mechanism may be used. Furthermore, instead of the electric motor 12, an internal-combustion engine may be used.

What is claimed is:

1. An air compressor, comprising:

a compressor configured to compress air;

a tank configured to store compressed air from the compressor;

a discharge pipe (i) configured to discharge the compressed air and a condensate in the tank to an outside of the tank and (ii) having a discharge pipe end portion including a discharge port facing upward at a tip end of the discharge pipe;

a drain cock that is (i) within a passage of the discharge pipe and (ii) configured to open and close the discharge pipe;

a tubular cover including (i) a top portion that covers the discharge port from above and (ii) an opening that faces downward;

a lower cover that covers the opening of the tubular cover; and a muffling member that is housed within the tubular cover so as to surround an outer circumference of the discharge port of the discharge pipe end portion; wherein:

the lower cover includes (i) a support portion that is configured to support the muffling member from below, (ii) a plurality of protrusions that form the support portion and protrude upward and (iii) a plurality of discharge grooves; and each of plurality of discharge grooves is between adjacent protrusions of the plurality of protrusions and is configured to guide the condensate in an outer peripheral direction.

2. The air compressor according to claim 1, wherein the muffling member is metal wool.

3. The air compressor according to claim 1, wherein the lower cover is connected to the tubular cover.

4. The air compressor according to claim 3, wherein the lower cover includes an outer peripheral surface configured to be tilted downward such that the outer peripheral surface has a tapered shape extending radially outward toward an outer peripheral edge.

5. The air compressor according to claim 4, wherein the tubular cover includes a bottom portion that is configured to be tilted downward in a tapered shape extending radially outward so as to face and run along the outer peripheral surface of the lower cover.

6. The air compressor according to claim 1, further comprising a second tank, wherein the discharge pipe end portion of the discharge pipe and the tubular cover are between the tank and the second tank.

7. The air compressor according to claim 1, wherein the discharge port of the discharge pipe end portion is configured to discharge the compressed air and the condensate in a direction against gravity.

8. The air compressor according to claim 1, wherein the top portion of the tubular cover faces the discharge port of the discharge pipe end portion.

9. The air compressor according to claim 1, wherein the discharge port of the discharge pipe end portion faces upward in a direction against gravity.

10. The air compressor according to claim 1, wherein the compressor is upward of the top portion of the tubular cover.

11. The air compressor according to claim 1, wherein the discharge port of the discharge pipe end portion faces in a direction away from the lower cover.

12. The air compressor according to claim 1, wherein the tubular cover does not have an opening upward of the discharge port of the discharge pipe end portion.

13. The air compressor according to claim 1, wherein the discharge port of the discharge pipe end portion faces in a direction away from the opening of the tubular cover.

14. The air compressor according to claim 5, wherein each of the plurality of protrusions includes an outer peripheral protrusion that has substantially a uniform height from the outer peripheral surface and that extends above and along the outer peripheral surface.

15. An air compressor, comprising:

a compressor configured to compress air;

a tank configured to store compressed air from the compressor;

a discharge pipe (i) configured to discharge the compressed air and a condensate in the tank to an outside of the tank and (ii) having a discharge pipe end portion including a discharge port facing upward at a tip end of the discharge pipe;

a drain cock that is (i) within a passage of the discharge pipe and (ii) configured to open and close the discharge pipe;

a tubular cover including (i) a top portion that covers the discharge port from above and (ii) an opening that faces downward; and a lower cover that (i) covers the opening of the tubular cover and (ii) includes an outer peripheral edge portion that is (a) radially inside an innermost edge of the opening of the tubular cover and (b) configured to guide the condensate to an exterior of the air compressor.

16. An air compressor according to claim 15, wherein the outer peripheral edge portion is configured to guide the condensate to a peripheral edge of the lower cover.

* * * * *